United States Patent [19]

Garchinsky

[11] 4,095,381

[45] Jun. 20, 1978

[54] POLE BASE MOUNT ASSEMBLY

[75] Inventor: John S. Garchinsky, Aldan, Pa.

[73] Assignee: Gar Design Research, Inc., Media, Pa.

[21] Appl. No.: 711,559

[22] Filed: Aug. 4, 1976

[51] Int. Cl.[2] ..... E02D 27/00; E04B 1/00

[52] U.S. Cl. ..... 52/295; 52/98; 52/127; 248/25; 52/296

[58] Field of Search ..... 52/292, 294, 296, 297, 52/98, 295, 298; 285/2, 3, 4, 44, 43; 85/50 R; 248/25, 500, 507, 508

[56] References Cited

U.S. PATENT DOCUMENTS

| | | | |
|---|---|---|---|
| 723,669 | 3/1903 | Hammann | 52/292 |
| 2,733,492 | 2/1956 | Copell | 248/507 X |
| 2,881,876 | 4/1959 | Williams | 52/295 |
| 3,311,333 | 3/1967 | Galloway | 52/296 X |
| 3,325,692 | 6/1967 | Manetti et al. | 248/507 X |
| 3,387,814 | 6/1968 | Fischer | 248/507 X |
| 3,552,073 | 1/1971 | Millerbernd | 52/98 |
| 3,645,057 | 2/1972 | Kaplan | 52/296 X |
| 3,951,556 | 4/1976 | Strizki | 52/98 |

*Primary Examiner*—Price C. Faw, Jr.

*Assistant Examiner*—Robert C. Farber

*Attorney, Agent, or Firm*—Nelson E. Kimmelman

[57] ABSTRACT

The assembly comprises a spun metal lower pole terminal portion having a plurality of apertures formed toward its lower edge. The terminal portion is placed over a concrete slab or other appropriate base having a plurality of spaced upstanding bolts protruding therefrom. The apertures are large enough to enable the installer to insert a special clamp through each aperture. The clamp has a bifurcated end portion which straddles one of the bolts whereas its other end portion protrudes somewhat through the aperture and has a portion in a vertical plane which acts to prevent lateral movement of the lower terminal portion. The installer then screws nuts over the bifurcated portion and the increased downward pressure is transmitted to a number of protuberances formed on the lower surface of the clamp which act to crush any small pebbles or solid aggregate appearing on the upper horizontal surface of the concrete slab. In another form, the clamps may be arranged so that they extend through the apertures in the lower terminal portion from outside the lower terminal portion; their bifurcated portions being placed astride bolts on a slab outside of the lower terminal portion.

15 Claims, 9 Drawing Figures

FIG. 5
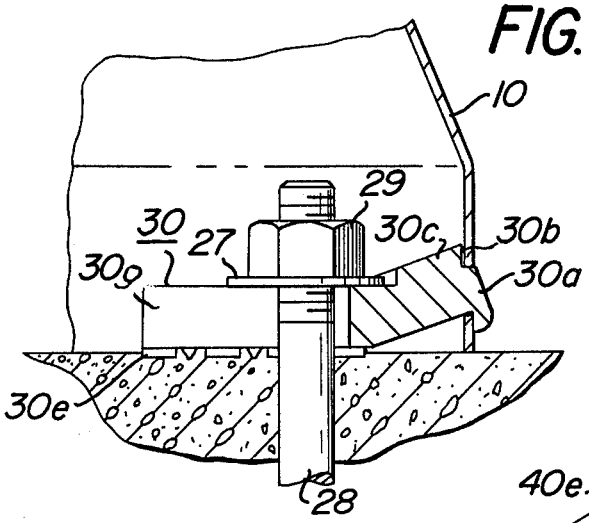
FIG. 6
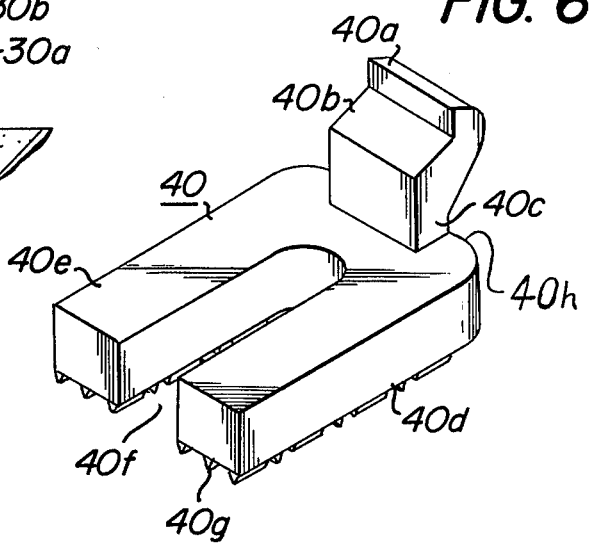
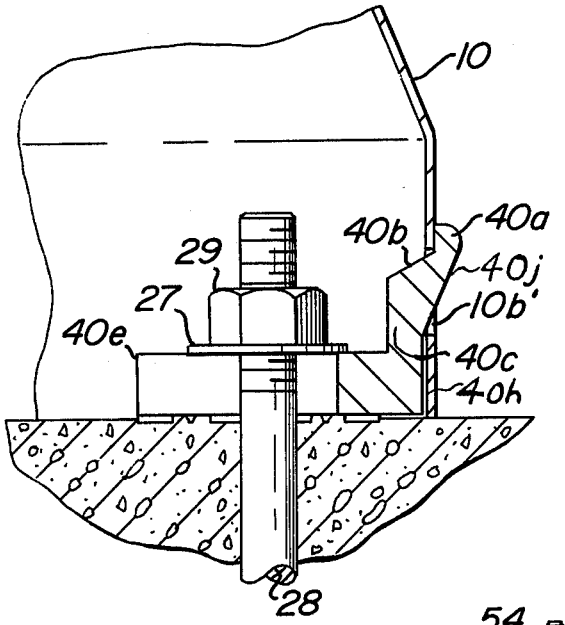
FIG. 7
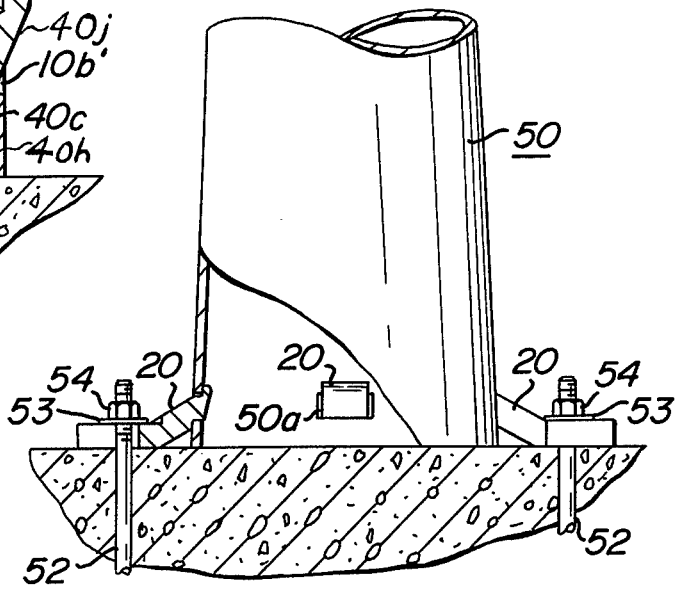
FIG. 8

POLE BASE MOUNT ASSEMBLY

BACKGROUND OF THE INVENTION

1. FIELD OF THE INVENTION

This invention relates to apparatus for securing the lower terminal portion of a pole or pole assembly in place.

2. PRIOR ART

Upright poles have been used for a variety of purposes in the past such as for holding street lights or, when used with a generally horizontal mast arm, for traffic lights. The lower parts of these poles in the past often passed through an upper central axial hole formed in a wider base to which it was welded. The bases were sometimes made of cast iron which made them quite heavy and bulky. They were expensive to ship both because of their weight and the space limitations on the quantity of them that could be shipped in any given carrier. These same characteristics also made such bases expensive to store.

These bases often had a number of inwardly turned "ears" welded to, integrally molded or otherwise affixed to the bottom of the base. These were intended to be respectively placed opposite one of a corresponding number of upstanding bolts protruding upward from a cement slab. The base also had a lateral hole large enough to enable the installer to stick his arm through it when the ears were aligned over the upstanding bolts and fully lowered to the slab. The installer could then fasten the ears within the base by nuts. However, in order to align the ears with the fixed bolts, it was necessary to revolve the base or pole-base assembly in a generally horizontal plane. Since the pole-base assembly might weigh, however, on the order of 150 pounds, the installer would either have to move it himself or ask for assistance from others. This, of course, required additional installation crew members and thus added to the cost of installation.

In recent years, government officials have begun to adopt the philosophy that such poles should be impact-yieldable. This philosophy is founded on the belief that if the pole was not a rigidly immovable object, it would prove less lethal to the driver of a car in the event that the car accidentally hit a pole.

It is therefore among the objects of the present invention to provide a pole-base mount which is less expensive to make, less expensive to install or store and less likely to inflict serious bodily damage upon the driver of a car which accidentally hits the mount.

SUMMARY OF THE INVENTION

A pole base mount for use with a substantially horizontal planar base includes a pole assembly having a lower terminal portion with a plurality of apertures formed therein. A corresponding plurality of clamps are respectively associated with the apertures. Each clamp has means enabling it to be releasably engaged by one of a number of upwardly extending fastening members attached to the planar base. Each clamp also has a first end portion dimensioned to pass through one aperture and has means at that end portion which prevents substantial lateral movement of the lower terminal portion when said end portion is passed through that aperture.

BRIEF DESCRIPTION OF THE DRAWINGS

FIG. 5 is a fragmentary sectional view showing another form of a clamp as used in the pole-base mount;

FIG. 6 is a perspective view of still another form of clamp in accordance with the present invention;

FIG. 7 is a fragmentary sectional view showing how the clamp of FIG. 6 is used with the lower terminal portion of a pole assembly;

FIG. 8 shows still another form of the invention in which the clamps engage the lower terminal portion of the pole assembly from the outside.

DETAILED DESCRIPTION OF THE PREFERRED EMBODIMENTS

Figure 1:
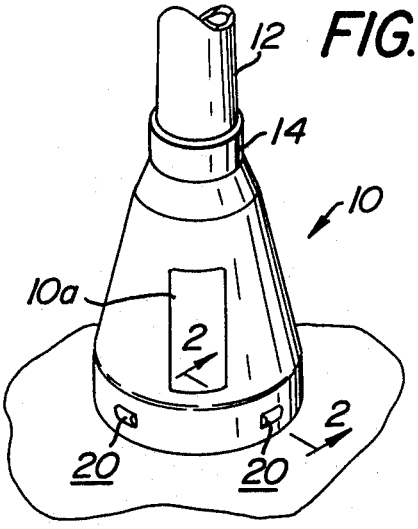
FIG. 1 is a fragmentary perspective view of the pole-base mount according to the present invention.
Figure 2:
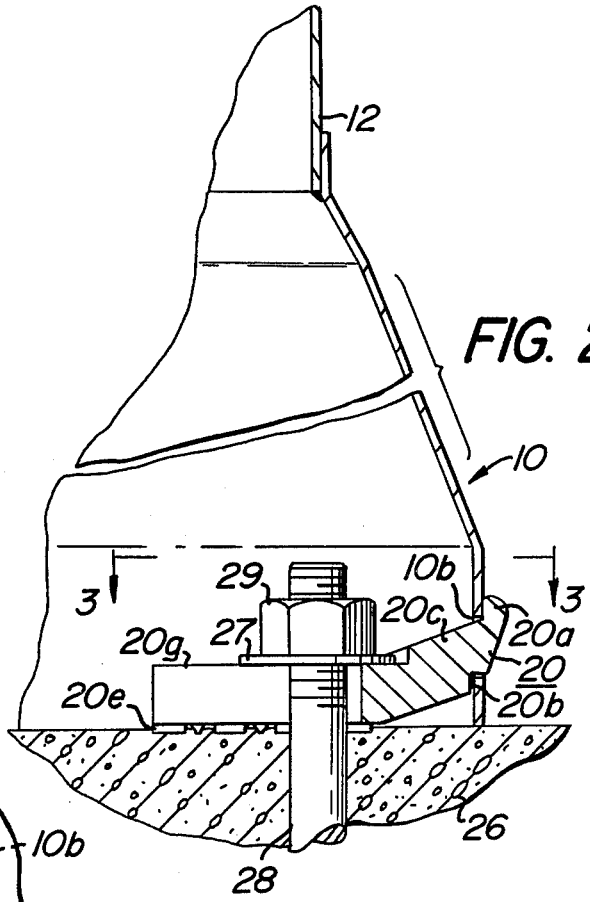
FIG. 2 is a fragmentary sectional view of a part of the apparatus shown in FIG. 1 taken along the section line 2—2 in the direction indicated.
Figure 3:
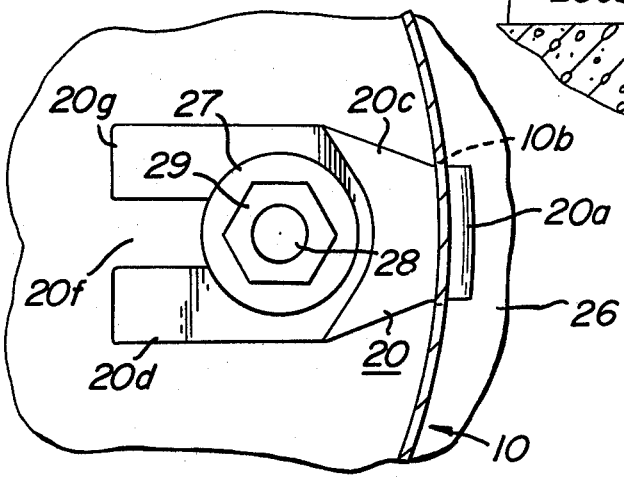
FIG. 3 is a sectional view of part of the apparatus shown in FIG. 2 taken along the section line 3—3 of FIG. 2.
Figure 4:
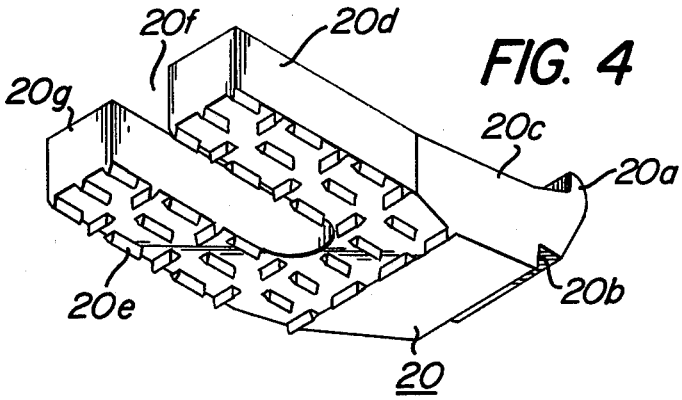
FIG. 4 is a perspective view showing the bottom of one form of the clamp used in the pole-base mount according to the present invention.

Referring first to FIGS. 1–4, there is shown a hollow metallic pole 12 fastened inside a collar portion 14 of a spun metal base 10. Instead of spun metal, a sheet type of metal such as aluminum or carbon or stainless steel could alternatively be used. As shown, the base has a generally truncated, conical shape and has a relatively large, generally rectangular opening in which a hinged door **10*a* is placed, the door being capable of swinging outwardly to allow the installer access to its interior. Formed along the lower edge of the base are a number of equally spaced, generally rectangular apertures 10*b*. During installation, the base 10 is placed over the concrete slab 26 and rotated by the installer until the apertures 10*b* are generally opposite corresponding ones of the upstanding bolts 28 moored in the slab. The operator then opens the door 10*a* and takes one of the members 20 by its bifurcated end, elevates that end and inserts its other end 20*a* through the aperture 10*b*. He then lowers the two legs 20*d* and 20*g* until the corresponding bolts 28 protrudes upward through the clearance 20*f* between them. While still reaching through the large opening, he places a washer 27 over a bolt 28 and then screws on the fastening bolt 29 with a wrench or equivalent. This will cause downward pressure on the clamp 20 whose lower horizontal surface is formed with a number of pointed protuberances or teeth 20*e*. Should there be any small pebbles under the lower surface of clamp 20, or should the surface of the slab 26 be uneven with coarse clumps of aggregate, these teeth will exert sufficient pressure to crush them. Then the lower surface of clamp 20 can make intimate contact with the upper surface of the slab 26**.

It will be noted that when the external portion **20*a* is in place, its upper vertical inner surface contacts the outer surface of the lower part of the base 10 and prevents the latter from moving laterally outwardly. Also, the vertical lower surface 20*b* tends to prevent appreciable lateral movement of the base 10 inwardly. The length of the legs 20*d* and 20*g* is deliberately made to be larger than necessary to enable the member 20** to be used where a new pole-base mount is to be used with older installations in which the bolts on the slab are closer together.

FIG. 5 shows still another form of the invention in which a slightly modified type of clamp 30 is used. Instead of having its external portion **30*a* turn up, it turns down. Thus, after being passed through the aperture 10***b*, the turned down portion restrains the base from outward lateral movement. The vertical surface 30*b* which is now above prevents appreciable lateral inward movement of the base. Portions 30*b*, 30*c*, 30*g* and 30*e* correspond to their counterparts 20*b*, 20*c*, 20*g* and 20*e* of the embodiment shown in FIGS. 1–4.

Still another form of the invention is shown in FIGS. 6 and 7. In this form the bifurcated legs 40*e* and 40*d* and the undersurface 40*g* are the same as in the other embodiments. The portions 40*c*, 40*b* and 40*a* which extend upwardly are somewhat different. The main reason for the change in the geometry of the clamp is to provide a predetermined point in the clamp portion which can be made to have a predetermined structural break-down strength. By constructing portion 40*c* so that it has a controlled thickness and is substantially perpendicular to the legs 40*e* and 40*d*, the yieldability of the clamp and the lower terminal portion of the pole-base assembly may be made predictable similar to the functioning of a fuse in an electrical circuit. The intent is to have the portions 40*c*, 40*b* and 40*a* snap away from the legs when the lateral impact on the pole-base assembly exceeds a certain force.

The intermediate portion has upper and lower surfaces 40*b* and 40*j* which are angled in the same way as the upper and lower surfaces of intermediate portion 20*c* of the first embodiment. This angularity in both instances serves to facilitate the insertion of the outer ends (40*a*, 20*a*) through the apertures by the installer who initially holds the legs 40*d*, 40*e* (or 20*g*, 20*d* in the first embodiment) higher than the outer ends. When the latter are through the apertures, he lowers the legs over the vertical bolts.

As shown in FIG. 7, the vertical surface of the portion 40*a* abuts the outside surface of the base 10. Because of the configuration of the upright portion of clamp 40, the apertures in the side of the base may have to be somewhat larger in the vertical direction as shown at 10*b*'. The angled surface 40*b* is to facilitate the passage of the outer end of clamp 40 through the aperture 10*b*'. It will be noted, also, that the bight 40*h* has an outer edge which is vertical and disposed in a closer, generally parallel relation to the inner surface of the base 10 which helps it to prevent lateral movement of the base. If struck by a car, the lower portion of base 10 will be forced inwardly together with the upright portion of clamp 40 until the latter snaps in the region 40*c*. The base will absorb some of the initial shock by deformation, but the lateral force will eventually cause it and its attached pole to keel over since one or more of the clamps 40 will snap at the weakest point.

Still another form of the invention is shown in FIG. 8 wherein there is no separate base portion. Instead, the pole 50 itself is hollow, has a lower flared portion which is equipped with a number of apertures 50*a* through which clamps such as the clamp 20 extend from the outside. In this embodiment, there is no need to have a much larger opening in the side of the pole 50 since the clamps are put in the holes 50*a* from the outside and their U-shaped portions straddle the bolts 52 which are placed in the slab outside the pole. Washers 53 and nuts 54 are then fixed in place and, if desired, the entire assemblage may be covered with protective caps or a protective ring.

What is claimed is:

1. A pole-base mount for affixation to a substantially horizontal planar base having a plurality of fastening means extending upward therefrom, comprising:

(a) a pole assembly having a lower terminal portion having generally vertical sides in a plurality of apertures are formed, and (b) a plurality of clamps associated respectively with said plurality of apertures, each clamp having means to enable it to be releasably engaged by one of said upwardly projecting fastening members, each clamp also having a first end portion dimensioned to pass through its associated aperture, said end portion including means for preventing substantial normal lateral movement of said terminal portion when said end portion is passed through its associated aperture.

2. The mount according to claim 1 wherein said preventing means includes a part which extends upwardly from the aperture after passing through it.

3. The mount according to claim 1 wherein said preventing means includes a part which extends downwardly from the aperture after passing through it.

4. The mount according to claim 1 wherein said clamp has a lower surface for contacting said planar base which includes a plurality of hard pointed portions.

5. The mount according to claim 1 wherein said means for enabling said clamp to be releasably engaged by one of said fastening members is an aperture formed in said clamp through which said fastening means can pass.

6. The mount according to claim 5 wherein said aperture is a clearance between two elongated leg members.

7. The mount according to claim 1 wherein said clamps are disposed primarily within said lower terminal portion of said pole assembly.

8. The mount according to claim 1 wherein said clamps are disposed primarily outside said lower terminal portion of said pole assembly except for said first end portions which extend within said lower terminal portion.

9. The mount according to claim 2 wherein each clamp also includes a generally vertical surface abutting the interior wall surface of said lower terminal portion for resisting inward lateral movement of said lower terminal portion.

10. The mount according to claim 1 wherein said lower terminal portion is constructed from a sheet-type metal and has an additional opening in the wall thereof to permit the installer to releasably secure the enabling means of said clamps to said upwardly projecting fastening members.

11. The mount according to claim 10 wherein said fastening members are a plurality of threaded members and wherein nuts are screwed onto said threaded members to releasably secure said clamps to said planar base.

12. The mount according to claim 1 wherein said clamps include a substantially flat portion, an angled portion connected thereto and said first end portion is connected to said angled portion, said angled portion facilitating the passage of said first end portion through its associated aperture when said clamp is inserted into said aperture from inside said outer terminal portion.

13. A clamp for use with a pole base mount that is to be affixed to a substantially horizontal planar base having a plurality of fastening members extending upward therefrom, said mount also including a pole assembly having a lower terminal portion which has a plurality of apertures therein, said clamp comprising:

(a) means enabling it to be releasably engaged by one of said upwardly projecting fastening members, and (b) a first end portion dimensioned to allow it to pass through one of said apertures, said end portion including means for preventing substantial lateral movement of said base when said end portion is passed through said aperture.

14. A pole assembly for mounting upon a substantially horizontal planar base in which a plurality of fastening members extend upwardly therefrom, said assembly comprising:

a lower terminal portion which is substantially hollow and formed of a sheet-type metal, said lower terminal portion having a plurality of apertures formed therein at spaced intervals toward the lower edge of said terminal portion, said apertures having dimensions enabling respective end portions of a plurality of clamps to extend therethrough when the rest of said clamp engages said fastening members within said lower terminal portion.

15. The pole assembly according to claim 14 wherein said lower terminal portion is formed of a spun metal.

* * * * *

UNITED STATES PATENT OFFICE

CERTIFICATE OF CORRECTION

PATENT NO. : 4,095,381

DATED : June 20, 1978

INVENTOR(S) : John S. Garchinsky

It is certified that error appears in the above-identified patent and that said Letters Patent are hereby corrected as shown below:

Claim 1, line 5, after "in" insert --which--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*